United States Patent [19]

Hernandez

[11] Patent Number: 4,942,850

[45] Date of Patent: Jul. 24, 1990

[54] DOUBLE-FLOW VALVE FOR INTERNAL COMBUSTION ENGINES

[76] Inventor: Angel G. Hernandez, Somontin, no 116, Madrid, Spain

[21] Appl. No.: 321,213

[22] Filed: Mar. 9, 1989

[30] Foreign Application Priority Data

Mar. 17, 1988 [ES] Spain ..... 8800810

[51] Int. Cl.[5] ..... F01L 1/28

[52] U.S. Cl. ..... 123/79 C

[58] Field of Search ..... 123/79 C, 188 B, 188 S C

[56] References Cited

U.S. PATENT DOCUMENTS

| | | | |
|---|---|---|---|
| 1,350,800 | 8/1920 | Greuter | 123/79 C |
| 2,211,013 | 8/1940 | Hosterman | 123/79 C |
| 2,213,202 | 9/1940 | Buchi | 123/79 C |
| 2,988,072 | 6/1961 | Colton | 123/79 C |
| 4,449,490 | 5/1984 | Hansen | 123/79 C |
| 4,503,817 | 3/1985 | Klomp et al. | 123/79 C |
| 4,539,950 | 9/1985 | Schaich | 123/79 C |
| 4,649,872 | 3/1987 | Solheim | 123/79 C |

FOREIGN PATENT DOCUMENTS

| | | | |
|---|---|---|---|
| 608210 | 3/1933 | Fed. Rep. of Germany | 123/79 C |
| 203767 | 9/1923 | United Kingdom | 123/79 C |

*Primary Examiner*—David A. Okonsky

*Attorney, Agent, or Firm*—Larson and Taylor

[57] ABSTRACT

An inlet and exhaust valve in internal combustion engines is described in the form of a vessel, designed with a large through cavity in its interior. The valve has two guiderods (8, 9) and two seating zones (1, 2), one on its internal side in which a conventional valve is fitted, and the other (1) on its external side where it itself fits onto the cylinder head. The design of this valve allows it to have a large dimension and from which it adjusts on its inside, factors which result in an increase in the combustibility of the gases, improving the efficiency of the engine. This improvement brings with it in addition a reduction in the emission of pollutant gases.

7 Claims, 6 Drawing Sheets

DOUBLE-FLOW VALVE FOR INTERNAL COMBUSTION ENGINES

The present invention refers to a double-flow valve for internal combustion engines.

BACKGROUND OF THE INVENTION

Internal combustion engines require two independent circuits for the flow of inlet and exhaust gases. The combustion chambers are circular in shape dictated by the design of the cylinder, and it is not known whether the valves which admit the gases give a better result if they are not similarly circular in shape, the fitting of which is in the form of a truncated cone, usually called the seating zone. However, this shape requirement gives rise to drawbacks relating to the measurements of the heads of the valves, since the circular shape leaves large useless spaces when there are two or more figures coming together in the same space. These problems bring about an insufficient proportioning of the heads of the valves, which prevents the cylinder from receiving and expelling an amount of gas flow appropriate to the size of the circumference of the piston.

The very nature of internal combustion in engines prevents, on the other hand, priority being given to the development of the dimensions of one valve over another, since any possible enlargement of the inlet valve would necessitate proportionally enlarging the exhaust valve, and that, due to the limited measurements of the combustion chamber, is obviously impossible.

Currently, some engine manufacturers have developed a system of multiple valves which, although they are smaller than the usual ones, achieve a higher efficiency, since as they are manufactured in pairs, that is two inlet valves and two exhaust valves, they form a smaller surface of dead space between their circular heads.

Another method of alleviating this problem is the application of turbine powered supercharging. This is a solution which presents considerable well documented problems, fundamentally due to the large dead zones in which the turbine does not provide an appreciable minimum of excess pressure.

The double-flow valve which is the subject of this invention endeavours to resolve the problems described above, to which end it multiplies the space available for the flow of gases, and it does this in a completely new and revolutionary way, channelling the inlet and exhaust gases independently along its external and internal sides. To do this, the said valve presents two seating surfaces, one on its external side which seats on the cylinder head, and the other on its internal side which serves as seat for a conventionally designed valve, but which is naturally larger than the usual ones. This conventional valve opens and closes the passage of gases on the inside. The double-flow valve, on which this invention is based, has two rods which receive the thrust of two cams, which operate simultaneously.

DETAILED DESCRIPTION OF THE INVENTION

In accordance with the invention, the double-flow valve for internal combustion engines is characterised in that it comprises a body with a large head, on the inside of which a circular through cavity is made, and a truncated cone shaped seating zone for the fitting of a valve which also has a section in the form of a truncated cone in its contact zone, suitable for fitting with the above, and which is located on the inside of the said body and arranged coaxially with it.

According to an additional characteristic of the valve which is the subject of this invention, this has cams, two for the body of the valve and one for the internal valve, the movement of which controls their opening and closing, and thereby controls the double circulation, external and internal, of the inlet and exhaust gases. The double flow valve fits into the cylinder head and is provided with a truncated zone shape seating zone for the said fitting. This fitting is done by coupling with a section of the cylinder head which shapes the valve and has similarly a truncated cone shape design.

In accordance with another additional characteristic of the valve which is the subject of this invention, this has recessing both on the inside and on the outside along which the internal and external gas flows circulate respectively.

In accordance with this characteristic, the double-flow valve of this invention has ducts for the entry and exit of gases to the cylinder arranged coaxially.

Also, in accordance with another aspect of this invention two opposing rods are provided which receive the simultaneous impulse of two cams, these same rods being subject to the returning impulse of the springs.

The double flow valve which is the subject of this application presents at least one groove on its external side which serves as housing for at least one elastic ring which guarantees a seal between the two circuits, fitting over a cylindrical surface which surrounds it, shaped in the cylinder head. Similarly, the elastic ring can be inserted into the said cylindrical surface.

BRIEF DESCRIPTION OF THE DRAWINGS

A series of drawings are provided below which endeavour to explain in greater detail the double-flow valve which is the subject of the invention, it being understood that these representations are merely for explanatory and illustrative purposes and are in no way limitative of the scope and spirit of this invention. In these.

DETAILED DESCRIPTION OF THE DRAWINGS

The double-flow valve which is the subject of this invention will be described in greater detail below with reference to the various figures on the attached drawings.

Figure 1:
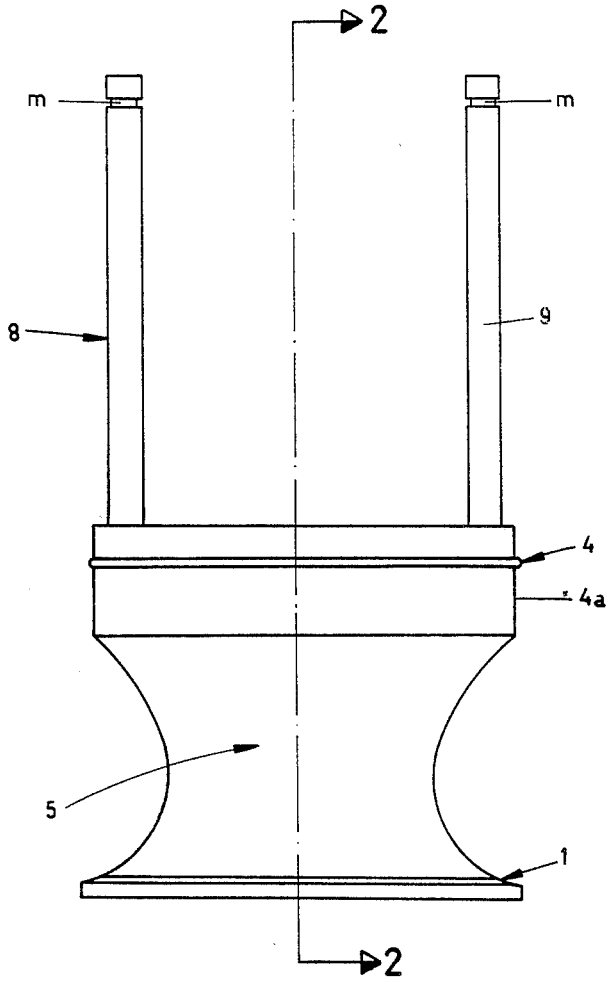
FIG. 1 shows a lateral view of a double-flow valve according to the invention.

In these, FIG. 1 shows a lateral view of the double-flow valve which is the subject of this invention, in which the truncated cone shape seat (1) on its external side can be seen. The body of the valve (5) itself is joined to this seat in one piece, finishing off in its upper part (4a) in which a groove is made into which an elastic ring (4) is lodged, the purpose of which is to guarantee a seal between the external and internal circuits of the inlet and exhaust gases. The push-rods of the double-flow valve are indicated with the figures 8 and 9. Each of the said rods (8, 9) has a recess (m) for the purpose of interlocking with each spring (11, 12, FIG. 3).

Figure 2:
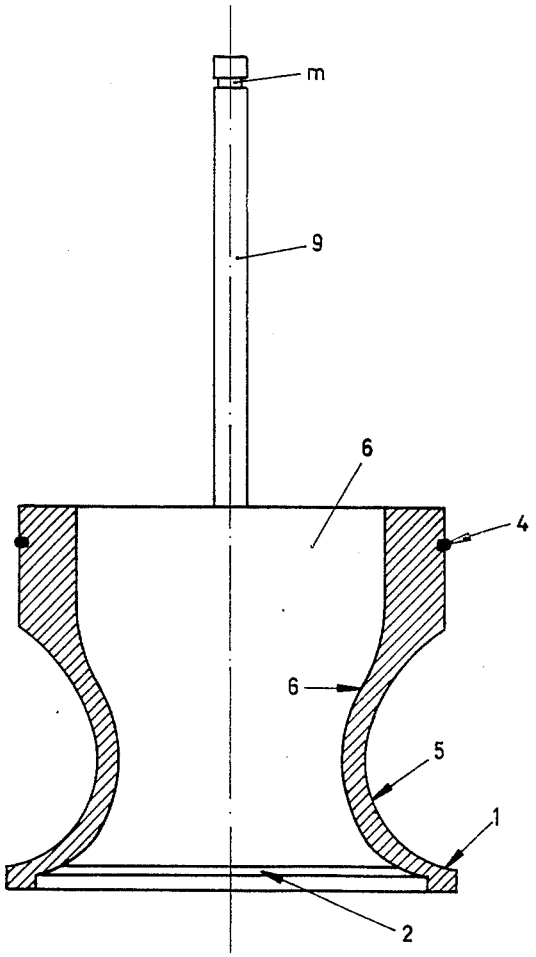
FIG. 2 shows a transverse section view of the double-flow valve along the line A—A of FIG. 1.

FIG. 2 shows a lateral view of the double-flow valve shown in FIG. 1, a cut having been made in it to reveal its internal zone. Apart from the various elements already explained in FIG. 1, in this FIG. 2 the internal passage of the valve which is the subject of the invention can be seen, which in this specific case is designed in the form of a convex tube. Also, an internal seating zone (2) of the double-flow valve can be observed, in addition to its external seating zone (1).

Figure 3:
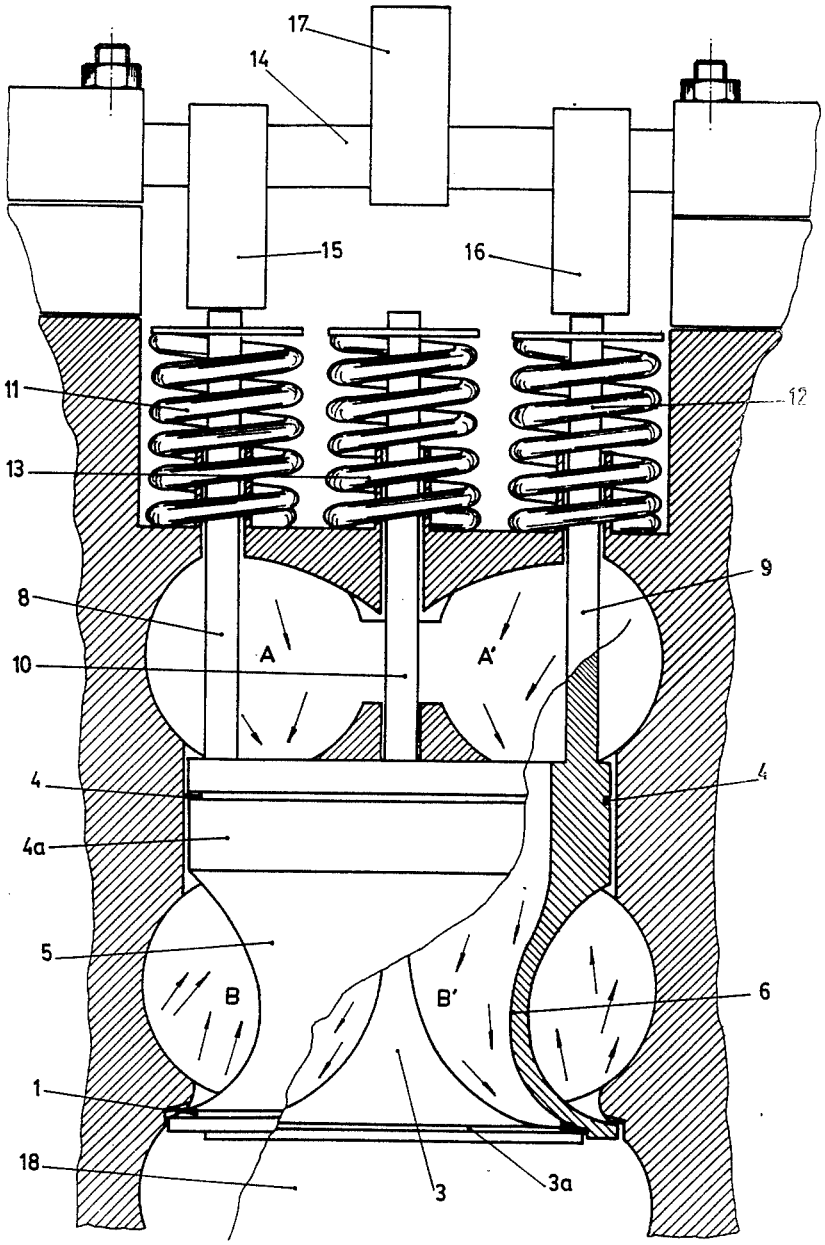
FIG. 3 shows a view of the double-flow valve which is the subject of the invention mounted on a cylinder head.

Passing now to FIG. 3, in this is shown a double-flow valve mounted on a cylinder head, in which its internal valve (3) can be seen, in a position ready for operation.

As can be seen, there are a series of cams (15 to 17) of the camshaft (14) to drive the different rods (8 to 10) of the external (5) and internal (3) components of the valves which form the inlet and exhaust system. On each of the rods (8 to 10), to be precise at their upper end, springs (11 to 13) are interlocked, which allow the alternate opening and shutting of the internal (3) and double-flow (5) valves by means of the corresponding action of the relevant cams (15 to 17). Apart from the different elements already mentioned in FIGS. 1 and 2, in FIG. 3 itself the nozzles for connection to the internal circuit (A, A') can be seen, which may form a single body and which flow together in the upper part of the double-flow valve. The nozzles of the external circuit (B, B') are interconnected between themselves as a result of the design of the external part (5) of the double-flow valve. In this figure, the respective arrows indicate the flow of the inlet gases (arrows pointing down) and the exhaust gases (arrows pointing up).

In this figure, the seat (3a) of the internal valve (3) as well as the compression chamber (18) can be seen.

Figure 4:
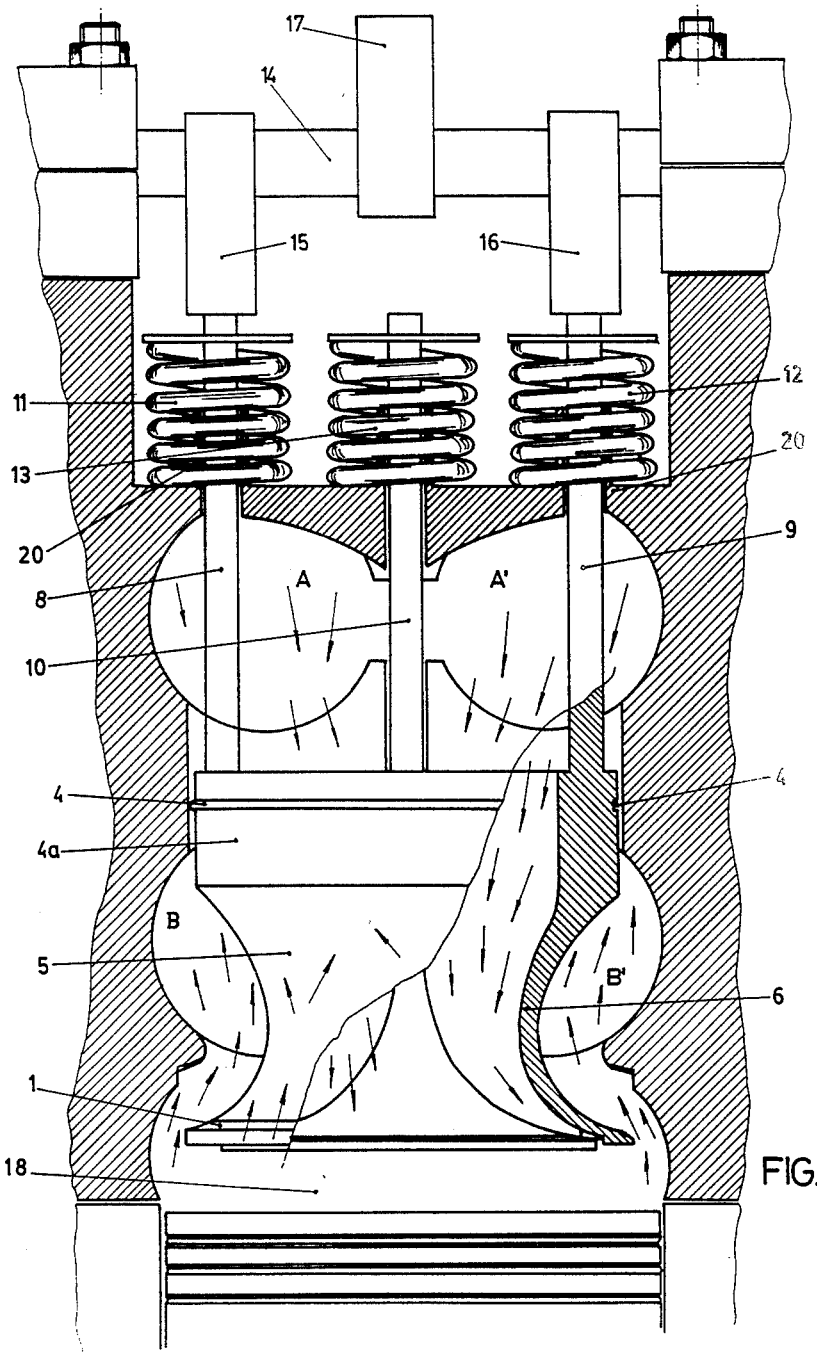
FIG. 4 shows the double-flow valve of FIG. 1, under operating conditions.

FIG. 4 shows the double-flow valve which is the subject of the invention in operation. In this figure it can be seen that the simultaneous action cams (15 and 16) press down on the heads of the rods (8, 9), and the double-flow valve is displaced. Each of these rods is guided through cylindrical guides (20) made in the cylinder head. At this moment the passage of flow through the external part is opened and connects to this circuit with the cylinder (19). In turn, the double-flow valve pulls the internal valve (3) along with its motion, it being possible to see that the central spring (13) is retracted whilst its corresponding driving cam (17) remains however at a distance.

Once the effect of the rotation of the camshaft makes the simultaneous action cams (15 and 16) move away from the rods (8, 9) of the double-flow valve, this draws back and the internal valve (3) does it in turn as a result of the action of the spring (13) to which it is joined, which remained retracted. During this operation both valves (3, 5) keep the connection with the internal circuit (the flow of which is represented by the arrows pointing down) closed and sealed, allowing only the connection with the corresponding external circuit (represented by arrows pointing up).

It is not necessary to recall here, as it is common knowledge, the universal form of valve-spring coupling by means of two cotters of conical design, upper washer and groove in the valve. For this reason this coupling is not shown in the figure. The camshaft does not necessarily have to bear directly onto the valves, but this bearing can be achieved by means of any of the known technical systems, for example rockers.

Figure 5:
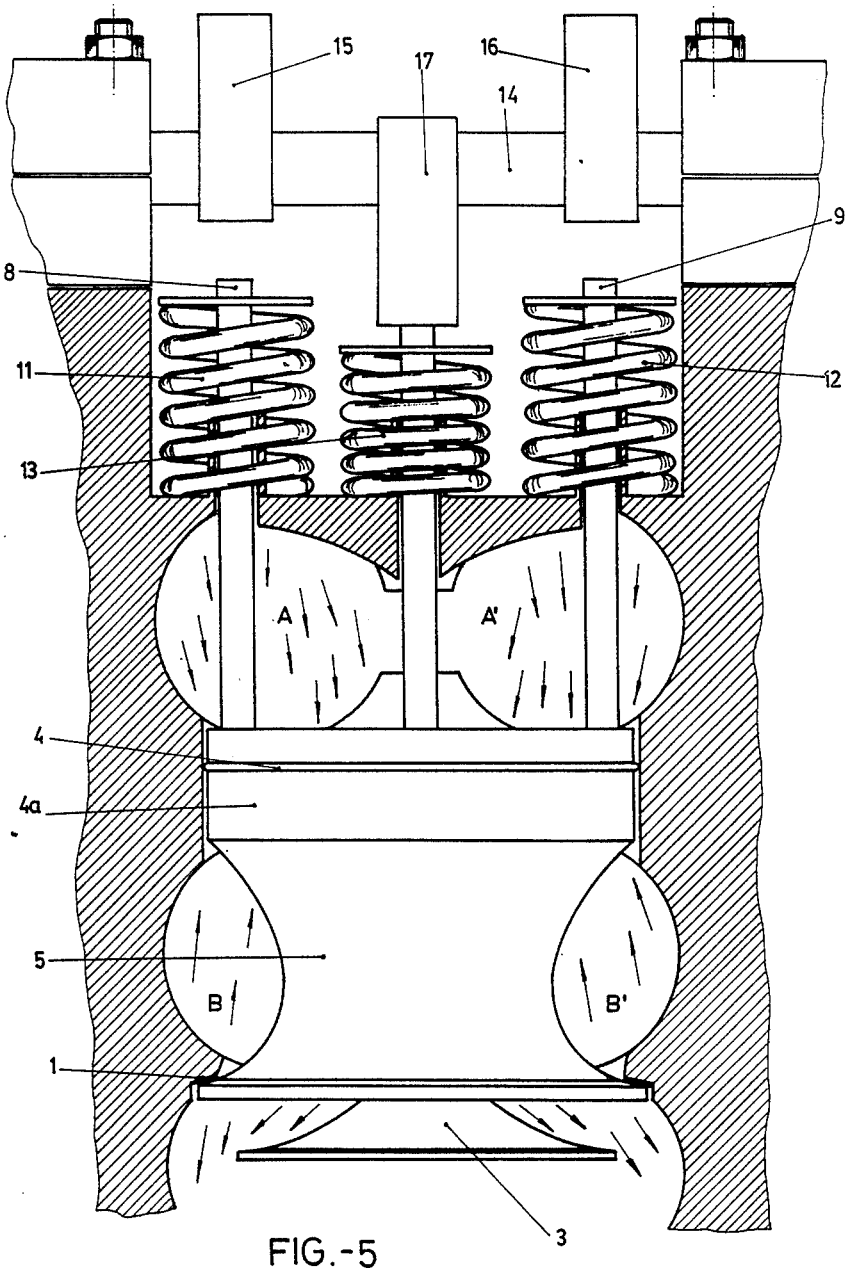
FIG. 5 shows the double-flow valve of FIG. 1, with its internal valve in operation.

In FIG. 5 the operation of the internal valve (3) is shown. In this case, the camshaft continues rotating and it can be seen how the cams (15, 16) of the double-flow valve are distanced from their respective rods (8, 9) and their respective springs (11, 12) are in an extended position. The double-flow valve remains fitted in its seat (1), and the elastic ring (4) which may be of metal, guarantees a seal between the two circuits.

As can be seen, the internal valve (3) is displaced by the impulse of its cam (17) and opens the way between the internal circuit (shown with arrows pointing down) and the cylinder (19). The cylinder thus has the facility of being filled or emptied generously thanks to the large dimensions obtained with this valve.

Once the cam (17) ceases to press down on the corresponding rod (10) due to the effect of the rotation of the camshaft, the internal valve (3) moves back to its fitted position where it seats with the interior of the double-flow valve. At this point the compression chamber (18) is closed.

Figure 6:
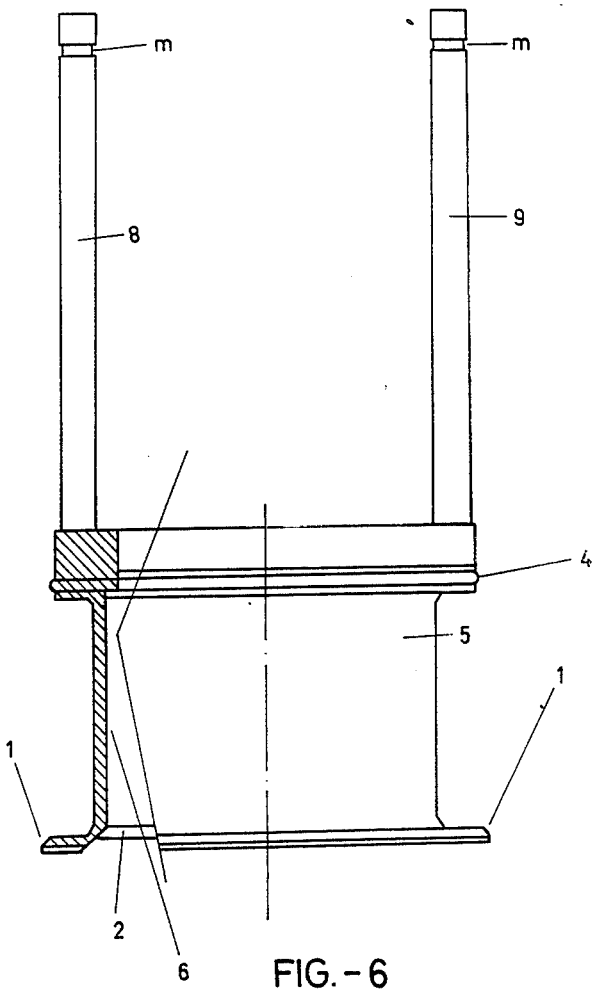
FIG. 6 shows an alternative version of the internal and external walls of the double-flow valve which is the subject of this invention.

Going on now to FIG. 6, in this is shown the double-flow valve which is the subject of this invention, in which its internal and external walls, which form the two internal and external circuits, are shown separated in perpendicular arrangement and in a straight line in respect to the seating which it makes on the cylinder head. It should be noted that the greater or lesser degree of curvature of these walls is immaterial as in practice either of these designs or any other of the outline of these walls could be used without influencing the nature of the invention. In this FIG. 6, the truncated cone shape seat (1) of the external circuit can be seen, the wall (5) which shapes the external circuit, the wall (6) which shapes the internal circuit and the truncated cone shape seat (2) which serves as the closing zone of the internal valve.

OPERATION

The operating cycle of this double-flow valve is as follows: we begin from the position of rest (FIG. 3) to which the said valve is subjected to the action of two springs which surround its two rods. In this position, the internal valve (3) remains fitted into the inside of the valve by the action of a spring (13). At this moment, the combustion chamber is closed and the cams on the camshaft are not pressing down. If we rotate the camshaft, we put pressure on the valve by means of the two cams (15, 16) which operate simultaneously (FIG. 4). At this point, the valve is displaced and opens a flow circuit through its external part which can be either in the inlet or exhaust direction. In this position, the double-flow valve displaces the valve which is fitted inside it, but the internal circuit which this valve has remains closed. The double-flow valve at this point allows a large capacity of flow through its external part, since it occupies a large surface in the combustion chamber. When this valve returns to its point of rest as a result of the action of the springs, it closes and hermetically seals the chamber. If we imagine that the flow has been inward, at this moment the cylinder is full of gases and the compression period begins. Both the external valve and the internal valve have moved in adjustment between one another and return to the point of closure or rest.

The internal circuit has not opened, since the pressure of movement has been given to it by the valve on its internal side pushing on the seat which is located between them.

The elastic ring which encircles fitting over the cylinder of the cylinder head to the valve guarantees a seal and independence between the two flow circuits.

Once the explosion takes place and when an outward flow is required, the internal valve comes into operation, and this is driven by the corresponding cam (FIG. 5) which suitably counterbalanced bears on the rod, whilst the cams which act simultaneously on the said valve move away from it. At this point, the internal circuit valve is displaced and opens the internal flow circuit, leaving a large dimension free for the outlet of gases.

The revolutionary design of this double-flow valve allows both the internal valve and the external valve to be designed with a large surface area, by which means the filling capacity of the cylinder is considerably increased.

It is important to point out that the direction of flow described in this specification may be altered if practice so requires; in other words, the internal circuit can be for inlet and the external for outlet.

Similarly, it is pointed out that the revolutionary design of this valve allows the installation of double and opposing circuits of the inlet and exhaust nozzles as can easily be seen in the attached drawings.

It should be understood that the above description of the double-flow valve which is the subject of this invention may undergo a range of variations and modifications which are to be understood as being included within the scope and spirit of this invention, the protection of which is applied for in the attached claims.

I claim:

1. A two-way valve for internal combustion engines, wherein there is a main body which is bowl shaped, and containing a cylindrical hollow, wherein at the top of said hollow, it connects with two cylindrical bars placed symmetrically, and at the bottom of said hollow, inside, there is a truncated cone shaped seating area which receives the adjustment of a standard design valve, outside said hollow at the bottom there is an area which extends outwardly from the bowl, and which is machined on top into a truncated cone, which serves to adjust into the body of the cylinder head, said symmetrical cylindrical bars projecting toward the top of the cylinder head, to receive the thrust from two cams on a camshaft, this two-way valve also having a cylindrical area with at least one circular groove into which an expansion ring is adjusted and which expands against a cylindrical zone in the cylinder head.

2. A two-way valve for internal combustion engines, as set forth in claim 1, wherein there is provision for the installation of a three-cam camshaft, two of the said cams acting at the same working angle on the two cylindrical bars of the two-way valve and the third of the said cams being placed between the other two and pressing on the internal valve bar.

3. A two-way valve for internal combustion engines, as set forth in claim 1, wherein the interior has a cylindrical space where the internal gas flow circulates.

4. A two-way valve for internal combustion engines, as set forth in claim 1, wherein the outside has a concave circular shaped space where the external gas flow circulates.

5. A two-way valve for internal combustion engines, as set forth in claim 1, wherein the ducting for the input and output of gas to and from the cylinder is arranged coaxially.

6. A two-way valve for internal combustion engines, as set forth in claim 1, wherein there is provision for two cylindrical bars forming an integral part of the two-way valve, said bars projecting towards the top of the cylinder head, along cylindrical guides, and being subjected to the action of one separate spring for each.

7. A two-way valve for internal combustion engines, as set forth in claim 1, wherein the top of the main body has, exactly where it connects with the two cylindrical bars, a cylinder shaped zone which has at least one groove running around it in a circle, and which enables the fitting of a flexible expansion ring which adjusts onto a cylindrical zone of the cylinder head.

* * * * *